US011686001B2

(12) United States Patent
Su et al.

(10) Patent No.: US 11,686,001 B2
(45) Date of Patent: Jun. 27, 2023

(54) EUTECTIC CERAMIC THERMAL BARRIER MATERIAL AND PREPARATION METHOD THEREOF

(71) Applicant: NORTHWESTERN POLYTECHNICAL UNIVERSITY, Xi'an (CN)

(72) Inventors: Haijun Su, Xi'an (CN); Zhonglin Shen, Xi'an (CN); Minghui Yu, Xi'an (CN); Haifang Liu, Xi'an (CN); Yinuo Guo, Xi'an (CN); Dianyun Wang, Xi'an (CN); Yuan Liu, Xi'an (CN); Di Zhao, Xi'an (CN); Taiwen Huang, Xi'an (CN); Wenchao Yang, Xi'an (CN)

(73) Assignee: Northwestern Polytechnical University, Xi'an (CN)

( * ) Notice: Subject to any disclaimer, the term of this patent is extended or adjusted under 35 U.S.C. 154(b) by 75 days.

(21) Appl. No.: 17/748,153

(22) Filed: May 19, 2022

(65) Prior Publication Data

US 2023/0035595 A1 Feb. 2, 2023

(30) Foreign Application Priority Data

May 19, 2021 (CN) ..... 202110543587.0

(51) Int. Cl.
*C23C 24/10* (2006.01)

(52) U.S. Cl.
CPC ..... *C23C 24/106* (2013.01)

(58) Field of Classification Search
CPC ..... B33Y 10/00; C23C 24/106
See application file for complete search history.

(56) References Cited

U.S. PATENT DOCUMENTS 9,776,282 B2 * 10/2017 Subramanian ..... B22F 10/28
2019/0135705 A1 * 5/2019 Yasui ..... C04B 35/653

FOREIGN PATENT DOCUMENTS

CN 110616394 A 12/2019
CN 112441834 A 3/2021

OTHER PUBLICATIONS

Microstructure tailoring and thermal stability of directionally solidified binary eutectic ceramics by laser floating zone melting, Haijun Su et al., Ceramics International, 44 (2018) 7908-7916.

* cited by examiner

*Primary Examiner* — Michael P Wieczorek
(74) *Attorney, Agent, or Firm* — Bay State IP, LLC

(57) ABSTRACT

The disclosure provides a eutectic ceramic thermal barrier material and a preparation method thereof, which relates to the field of composite materials. The present disclosure provides a eutectic ceramic thermal barrier material comprising a nickel-based superalloy substrate, an intermediate binding layer and a eutectic ceramic cladding layer stacked sequentially; the intermediate binding layer comprises a NiCoCrAlY binding layer; the eutectic ceramic cladding layer comprises an $Al_2O_3/GdAlO_3$ binary eutectic ceramic coating or an $Al_2O_3/GdAlO_3/ZrO_2$ ternary eutectic ceramic coating. The eutectic ceramic thermal barrier material provided by the present disclosure has good high temperature resistance, good oxidation resistance and excellent mechanical properties.

11 Claims, 1 Drawing Sheet

EUTECTIC CERAMIC THERMAL BARRIER MATERIAL AND PREPARATION METHOD THEREOF

CROSS REFERENCE TO RELATED APPLICATION

This patent application claims the benefit and takes priority from the Chinese Patent Application No. 202110543587.0 filed on May 19, 2021, the contents of which are incorporated by reference herein in its entirety as part of the present application.

TECHNICAL FIELD

The disclosure relates to the field of composite materials, and more particularly to a eutectic ceramic thermal barrier material and a preparation method thereof.

BACKGROUND

Nickel-based superalloys have good comprehensive properties, such as excellent high temperature strength, creep resistance, high fatigue life, etc., and become the best candidate materials for key hot-end components in the aviation field such as modern turbojet engines and rocket engines. With the rapid development of aviation technology, the service environment of hot-end components in the aviation field is more complex and severe, and its working environment temperature is close to 1400° C., and is expected to exceed 2000° C.

At present, the maximum temperature of nickel-based superalloys used in hot-end components is only 1080° C., and with the increase of temperature, the degree of oxidation increases, and the strength, toughness, hardness and other properties decrease, which becomes the main obstacle restricting the development of nickel-based superalloys.

SUMMARY

An object of the present disclosure is to provide a eutectic ceramic thermal barrier material and a preparation method thereof. The eutectic ceramic thermal barrier material provided by the present disclosure has a high bonding strength between the eutectic ceramic cladding layer and the nickel-based superalloy substrate, good high temperature resistance, good oxidation resistance and excellent mechanical properties.

In order to achieve the object of the present disclosure, the present disclosure provides the following technical schemes:

The present disclosure provides a eutectic ceramic thermal barrier material, wherein comprising a nickel-based superalloy substrate, an intermediate binding layer and a eutectic ceramic cladding layer stacked sequentially; the intermediate binding layer comprises a NiCoCrAlY binding layer; the eutectic ceramic cladding layer comprises an $Al_2O_3/GdAlO_3$ binary eutectic ceramic coating or an $Al_2O_3/GdAlO_3/ZrO_2$ ternary eutectic ceramic coating.

In some embodiments, the nickel-based superalloy substrate comprises an IN718 superalloy substrate; and the nickel-based superalloy substrate has a thickness of 2-100 mm.

In some embodiments, the intermediate binding layer has a thickness of 50-200 μm.

In some embodiments, the eutectic ceramic cladding layer has a thickness of 300-750 μm.

The present disclosure also provides a method for preparing the eutectic ceramic thermal barrier material according to above technical schemes, comprising the steps of:

(1) Subjecting a nickel-based superalloy powder to laser cladding, and stacking layer by layer to obtain the nickel-based superalloy substrate;

(2) Subjecting a NiCoCrAlY powder to laser cladding on a surface of the nickel-based superalloy substrate, and stacking layer by layer to obtain an intermediate binding layer;

(3) Subjecting a eutectic ceramic powder to laser cladding on a surface of the intermediate binding layer, stacking layer by layer to obtain the eutectic ceramic cladding layer, and then to obtain the eutectic ceramic thermal barrier material; and the eutectic ceramic powder comprises an $Al_2O_3$—$Gd_2O_3$ spherical powder or an $Al_2O_3$—$Gd_2O_3$—$ZrO_2$ spherical powder.

In some embodiments, the laser cladding in step (1) is fiber laser cladding.

In some embodiments, the laser cladding in step (2) is fiber laser cladding.

In some embodiments, the laser cladding in step (3) is carbon dioxide laser cladding.

In some embodiments, the $Al_2O_3$—$Gd_2O_3$ spherical powder in step (3) has a particle size distribution of 10-50 μm; and a molar ratio of $Al_2O_3$ and $Gd_2O_3$ in the $Al_2O_3$—$Gd_2O_3$ spherical powder is 77:23.

In some embodiments, the $Al_2O_3$—$Gd_2O_3$—$ZrO_2$ spherical powder in step (3) has a particle size distribution of 10-50 μm; and a molar ratio of $Al_2O_3$, $Gd_2O_3$ and $ZrO_2$ in the $Al_2O_3$—$Gd_2O_3$—$ZrO_2$ spherical powder is 58:19:23.

The present disclosure provides a eutectic ceramic thermal barrier material, wherein comprising a nickel-based superalloy substrate, an intermediate binding layer and a eutectic ceramic cladding layer stacked sequentially; the intermediate binding layer comprises a NiCoCrAlY binding layer; the eutectic ceramic cladding layer comprises an $Al_2O_3/GdAlO_3$ binary eutectic ceramic coating or an $Al_2O_3/GdAlO_3/ZrO_2$ ternary eutectic ceramic coating. The present disclosure uses $Al_2O_3/GdAlO_3$ binary eutectic ceramic coating or $Al_2O_3/GdAlO_3/ZrO_2$ ternary eutectic ceramic coating as thermal barrier coating, which can improve the high temperature strength and oxidation resistance of the material. The NiCoCrAlY binding layer is used as the intermediate binding layer, which can effectively avoid the coating cracking failure caused by the difference of thermal expansion coefficient between the eutectic ceramic cladding layer and the nickel-based superalloy substrate, and thus improving the bonding strength between the eutectic ceramic cladding layer and the nickel-based superalloy substrate. The eutectic ceramic thermal barrier material provided by the present disclosure has good high temperature resistance, good oxidation resistance and excellent mechanical properties.

DETAILED DESCRIPTION OF THE EMBODIMENTS

Figure 1:
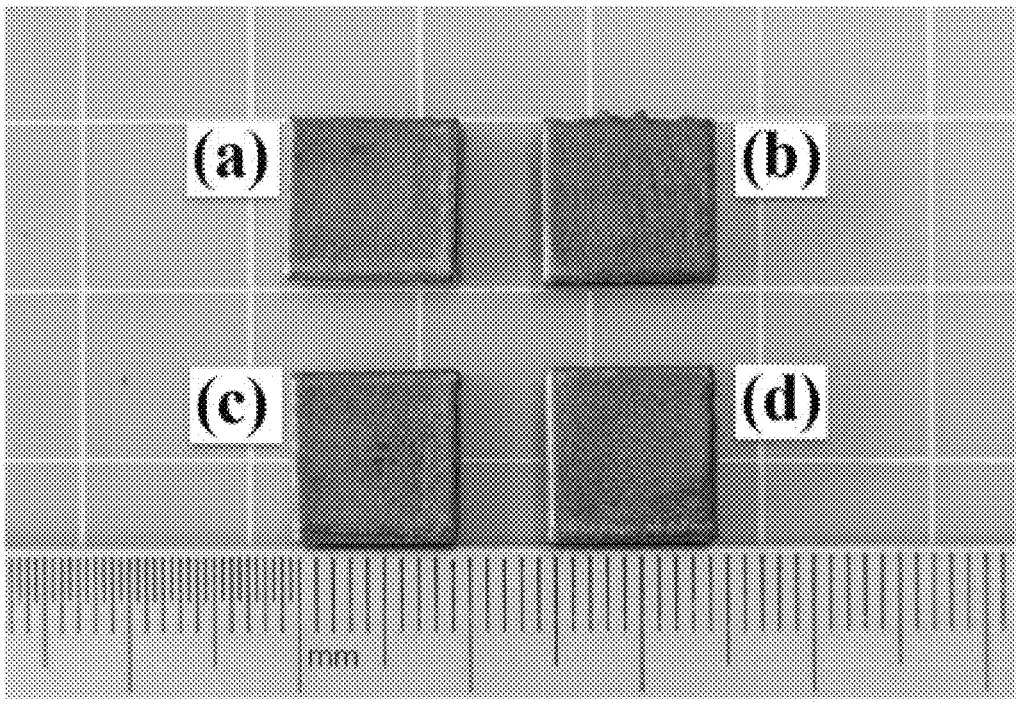
FIG. 1 shows morphology of $Al_2O_3/GdAlO_3$ binary eutectic ceramic coatings prepared in Examples 1-4.

The present disclosure provides a eutectic ceramic thermal barrier material, wherein comprising a nickel-based superalloy substrate, an intermediate binding layer and a eutectic ceramic cladding layer stacked sequentially; the intermediate binding layer comprises a NiCoCrAlY binding layer; the eutectic ceramic cladding layer comprises an $Al_2O_3/GdAlO_3$ binary eutectic ceramic coating or an $Al_2O_3/GdAlO_3/ZrO_2$ ternary eutectic ceramic coating.

The eutectic ceramic thermal barrier material provided by the present disclosure comprises a nickel-based superalloy substrate. In the present disclosure, the nickel-based superalloy substrate preferably comprises an IN718 superalloy substrate. In the present disclosure, in terms of mass percentage, the chemical composition of the IN718 superalloy substrate comprises 52.14% Ni, 19.14% Cr, 3.13% Mo, 5.41% Nb 0.28% Co, 0.23% Al, 0.76% Ti, 0.044% Mn, 0.18% Si, 0.028% Cu, 0.0191% C, 0.0011% S and 0.003% B.

In the present disclosure, the nickel-based superalloy substrate preferably has a thickness of 2-100 mm, more preferably 5-20 mm. In an embodiment, the nickel-based superalloy substrate preferably has a size of 8 mm×8 mm×5 mm or 15 mm×25 mm×5 mm.

The eutectic ceramic thermal barrier material provided by the present disclosure comprises an intermediate binding layer disposed on the surface of the nickel-based superalloy substrate. In the present disclosure, the intermediate binding layer comprises a NiCoCrAlY binding layer; the intermediate binding layer preferably has a thickness of 50-200 μm, more preferably 50-100 μm.

The eutectic ceramic thermal barrier material provided by the present disclosure comprises a eutectic ceramic cladding layer disposed on the surface of the intermediate binding layer. In the present disclosure, the eutectic ceramic cladding layer preferably comprises an $Al_2O_3/GdAlO_3$ binary eutectic ceramic coating or an $Al_2O_3/GdAlO_3/ZrO_2$ ternary eutectic ceramic coating. In the present disclosure, a volume ratio of $Al_2O_3$ and $GdAlO_3$ in the $Al_2O_3/GdAlO_3$ binary eutectic ceramic coating is preferably 49.7:50.3; a volume ratio of $Al_2O_3$, $GdAlO_3$ and $ZrO_2$ in the $Al_2O_3/GdAlO_3/ZrO_2$ ternary eutectic ceramic coating is preferably 37.33:44.7:17.9.

In the present disclosure, the eutectic ceramic cladding layer preferably has a thickness of 300-750 μm, more preferably 500-700 μm.

In the present disclosure, when the eutectic ceramic cladding layer is an $Al_2O_3/GdAlO_3$ binary eutectic ceramic coating, the eutectic ceramic cladding layer preferably has a thickness of 300-700 μm, more preferably 500-700 μm. In the present disclosure, an average eutectic spacing of the internal microstructure of the $Al_2O_3/GdAlO_3$ binary eutectic ceramic coating is preferably 110±4 nm.

When the eutectic ceramic cladding layer is an $Al_2O_3/GdAlO_3/ZrO_2$ ternary eutectic ceramic coating, the eutectic ceramic cladding layer preferably has a thickness of 300-750 μm, more preferably 500-750 μm. In the present disclosure, an average eutectic spacing of the internal microstructure of the $Al_2O_3/GdAlO_3/ZrO_2$ ternary eutectic ceramic coating is preferably 110±4 nm.

In the present disclosure, the average eutectic spacing of the internal microstructure of the eutectic ceramic cladding layer is small, which is beneficial to improve the mechanical properties of the material.

In the present disclosure, the eutectic ceramic cladding layer has excellent high temperature resistance, oxidation resistance and structural stability.

The present disclosure also provides a method for preparing the eutectic ceramic thermal barrier material according to above technical schemes, comprising the steps of:

(1) Subjecting a nickel-based superalloy powder to laser cladding, and stacking layer by layer to obtain the nickel-based superalloy substrate;

(2) Subjecting a NiCoCrAlY powder to laser cladding on a surface of the nickel-based superalloy substrate, and stacking layer by layer to obtain an intermediate binding layer;

(3) Subjecting a eutectic ceramic powder to laser cladding on a surface of the intermediate binding layer, stacking layer by layer to obtain the eutectic ceramic cladding layer, and then to obtain the eutectic ceramic thermal barrier material; and the eutectic ceramic powders comprise $Al_2O_3$—$Gd_2O_3$ spherical powders or $Al_2O_3$—$Gd_2O_3$—$ZrO_2$ spherical powders.

In the present disclosure, unless otherwise specified, the used preparation raw materials are all commercially available products known to those skilled in the art or prepared by conventional preparation methods.

In the present disclosure, the laser cladding of the substrate, the laser cladding of the intermediate binding layer and the laser cladding of the eutectic ceramic coating are independently preferably selective laser cladding. The present disclosure adopts selective laser cladding to prepare the eutectic ceramic thermal barrier material, which can completely melt the powder raw material by laser beam and rapidly solidify the material, thereby improving the bonding strength of the coating and the substrate, and improving the wear resistance, corrosion resistance, high temperature resistance and oxidation resistance of eutectic ceramic thermal barrier materials.

In the present disclosure, the nickel-based superalloy powder is subjected to laser cladding, and the nickel-based superalloy substrate is obtained by stacking layer by layer. In the present disclosure, the nickel-based superalloy powder is preferably IN718 superalloy powder. In the present disclosure, the nickel-based superalloy powder is preferably prepared by a gas atomization method. The present disclosure has no special requirements on the specific operations of the gas atomization method, and the operation well known to those skilled in the art can be adopted. In the present disclosure, the nickel-based superalloy powder preferably has a particle size of 5-45 μm, more preferably 15-45 μm. In the present disclosure, the nickel-based superalloy powder is preferably used after drying, the drying temperature is preferably 80° C., and the drying time is preferably 4 h.

In the present disclosure, the laser cladding of the substrate is preferably fiber laser cladding, the equipment used is preferably a fiber laser, and the metal powder has a high absorption rate for the laser. In the present disclosure, the diameter of the laser spot is preferably 75 μm, and the maximum laser power is preferably 500 W. In the present disclosure, the laser power of the laser cladding of the substrate is preferably 250-350 W; the scanning rate is preferably 0.6-0.85 m/s, more preferably 0.833 m/s. In the present disclosure, the laser scanning method of the laser cladding of the substrate is preferably "zigzag" scanning within the layer, and unidirectional scanning in the X direction between the layers or alternate scanning in the XY direction rotated by 900 between the layers; the line width of the laser scanning is preferably 0.02-0.5 mm, more preferably 0.075 mm. In the present disclosure, better bonding between layers in the eutectic ceramic thermal barrier material can be achieved by optimizing the scanning strategy.

In the present disclosure, the total number of layers stacked during the laser cladding of the substrate is preferably 100-200 layers, more preferably 100-150 layers; the thickness of each layer is preferably 0.02-0.5 mm, more preferably 0.05-0.075 mm.

In the present disclosure, the laser cladding of the substrate is preferably carried out in a protective atmosphere, particularly preferably in an argon atmosphere.

In the present disclosure, the specific method for the laser cladding of the substrate preferably includes:

(1) Using Magics software to build a cube model and create model slicing information to generate a CLI. file;

(2) Opening ARPSM. software to create a laser scanning strategy, generate a scanning strategy, and create an afi. file that can be recognized by a 3D printing equipment;

(3) Subjecting the nickel-based superalloy powder to selective laser cladding by fiber laser, and stacking layer by layer to obtain the nickel-based superalloy substrate.

In the present disclosure, the size of the cube model is preferably (8-15) mm×(8-20) mm×(5-10) mm, more preferably 8 mm×8 mm×5 mm or 15 mm×20 mm×5 mm. In the present disclosure, the Magics software is a three-dimensional modeling software, which can establish and modify models and perform layered slicing processing. It is efficient and fast, which can realize the perfect combination of components individualization and batch efficient production. During the experiment, parameters can be modified in time or multiple groups of models and control groups can be created.

In the present disclosure, the specific processing process of the selective laser cladding is as follows:

Step one, sequentially turning on a refrigeration dryer, an air compressor, main power supply of a control cabinet, a water cooler and power supply of an equipment, and opening the processing program on the computer control interface; turning on the motor button, clicking the "door lock of the work cabin" to open the cabin, and placing the substrate after cleaning and drying with industrial alcohol on a workbench, clicking the "motor" button, and adjusting the workbench to an appropriate processing position;

Step two, inputting the afi. file into the computer control system and opening on the processing interface, and setting the layer thickness to 0.02 mm-0.5 mm, preferably 0.05 mm; and evenly depositing the nickel-based superalloy powder on the processing area of the substrate;

Step three, setting processing parameters;

Step four, closing the door of the working cabin, opening an argon gas bottle, and turning on the purge button. When the oxygen content drops to less than 200 ppm, sequentially turning on the cooler, scanner, and laser; setting the ventilation and circulation system, setting the fan frequency to 20 Hz, and carrying out selective laser cladding to prepare the nickel-based superalloy substrate.

In the present disclosure, after obtaining the nickel-based superalloy substrate, the NiCoCrAlY powder is subjected to laser cladding on the surface of the nickel-based superalloy substrate, and the intermediate binding layer is obtained by stacking layer by layer. In the present disclosure, the NiCoCrAlY powder is preferably spherical powder; and the NiCoCrAlY powder preferably has a particle size of 45-90 μm, more preferably 45-60 μm. In the present disclosure, the NiCoCrAlY powder is preferably used after drying, the drying temperature is preferably 80° C., and the drying time is preferably 4 h.

In the present disclosure, before the laser cladding of the intermediate binding layer is performed, the nickel-based superalloy substrate is preferably pretreated. In the present disclosure, the pretreatment preferably includes sanding, cleaning and drying performed in sequence. In the present disclosure, the sanding preferably includes: sanding the nickel-based superalloy substrate with 160 mesh and 240 mesh sandpapers in sequence. In the present disclosure, the cleaning is preferably ultrasonic cleaning, and cleaning agent used for the cleaning is preferably anhydrous ethanol. In the present disclosure, the drying temperature is preferably 80° C., and the drying time is preferably 2 h. In the present disclosure, the pretreatment of the nickel-based superalloy substrate can keep the surface of the substrate dry and clean, so as to prevent the introduction of water vapor or impurities during processing.

In the present disclosure, the laser cladding of the intermediate binding layer is preferably fiber laser cladding, and the equipment used is preferably a fiber laser. In the present disclosure, the diameter of the laser spot of the fiber laser is preferably 75 μm, and the maximum laser power is preferably 500 W. In the present disclosure, the laser power of the laser cladding of the intermediate binding layer is preferably 250-350 W, more preferably 275 W; the scanning rate is preferably 0.6-0.85 m/s, more preferably 0.833 m/s. In the present disclosure, the laser scanning method for the laser cladding of the intermediate binding layer is preferably "zigzag" scanning within the layer, and alternate scanning in the XY direction rotated by 900 between the layers.

In the present disclosure, the total number of layers stacked during the laser cladding of the intermediate binding layer is preferably 1-10 layers, more preferably 2-3 layers; the thickness of each layer is preferably 50-150 μm, more preferably 100 μm.

In the present disclosure, the laser cladding of the intermediate binding layer is preferably carried out under a protective atmosphere, and particularly preferably an argon atmosphere.

In the present disclosure, the specific processing process of the laser cladding of the intermediate binding layer preferably includes:

Step one, inputting the afi. file described in the laser cladding of the substrate into the computer control system and opening on the processing interface;

Step two, setting processing parameters;

Step three, placing the nickel-based superalloy substrate, and using a scraper to lay NiCoCrAlY alloy powder on the surface of the nickel-based superalloy substrate; evenly depositing the NiCoCrAlY powder on the processing area of the substrate; and the thickness of the powder layer is 0.02-0.5 mm, preferably 0.1 mm;

Step four, closing the door of the working cabin, opening the argon gas bottle, and turning on the purge button. When the oxygen content drops to less than 200 ppm, sequentially turning on the cooler, scanner, and laser; setting the ventilation and circulation system, setting the fan frequency to 20 Hz, and carrying out selective laser cladding to prepare the NiCoCrAlY binding layer.

After obtaining the intermediate binding layer, the eutectic ceramic powder is subjected to laser cladding on the surface of the intermediate binding layer, the eutectic ceramic cladding layer is obtained by stacking layer by layer, and thus the eutectic ceramic thermal barrier material is obtained. In the present disclosure, the eutectic ceramic powder includes an $Al_2O_3$—$Gd_2O_3$ spherical powder or an $Al_2O_3$—$Gd_2O_3$—$ZrO_2$ spherical powder. In the present disclosure, the eutectic ceramic powder is preferably used after drying, and the temperature of the drying is preferably 80° C., and the time of drying is preferably 4 h.

In the present disclosure, the $Al_2O_3$—$Gd_2O_3$ spherical powder is preferably prepared by spray granulation. In the present disclosure, the preparation method of the $Al_2O_3$—

$Gd_2O_3$ spherical powder preferably includes: mixing $Al_2O_3$ powder and $Gd_2O_3$ powder according to a eutectic ratio and then granulating to obtain $Al_2O_3$—$Gd_2O_3$ spherical powder. In the present disclosure, the molar ratio of the $Al_2O_3$ powder and the $Gd_2O_3$ powder is preferably 77:23. In the present disclosure, the mixing is preferably by ball milling. In the present disclosure, the granulation is preferably spray granulation. In the present disclosure, the spherical powder obtained after granulation is preferably dried to obtain the $Al_2O_3$—$Gd_2O_3$ spherical powder. In the present disclosure, the drying temperature is preferably 100° C., and the time is preferably 4 h. The $Al_2O_3$—$Gd_2O_3$ spherical powder prepared by the present disclosure has better fluidity.

In the present disclosure, the $Al_2O_3$—$Gd_2O_3$ spherical powder preferably has a particle size distribution of 10-50 μm, more preferably 15-45 μm, further preferably 15-30 μm; the molar ratio of $Al_2O_3$ and $Gd_2O_3$ in the $Al_2O_3$—$Gd_2O_3$ spherical powder is preferably 77:23.

In the present disclosure, the $Al_2O_3$—$Gd_2O_3$—$ZrO_2$ spherical powder is preferably prepared by spray granulation. In the present disclosure, the preparation method of the $Al_2O_3$—$Gd_2O_3$—$ZrO_2$ spherical powder preferably includes: mixing $Al_2O_3$ powder, $Gd_2O_3$ powder and $ZrO_2$ powder according to a eutectic ratio and then granulating to obtain $Al_2O_3$—$Gd_2O_3$—$ZrO_2$ spherical powder. In the present disclosure, the molar ratio of the $Al_2O_3$ powder, the $Gd_2O_3$ powder and the $ZrO_2$ powder is preferably 58:19:23. In the present disclosure, the mixing method is preferably ball milling. In the present disclosure, the granulation is preferably spray granulation. In the present disclosure, the spherical powder obtained after granulation is preferably dried to obtain $Al_2O_3$—$Gd_2O_3$—$ZrO_2$ spherical powder. In the present disclosure, the drying temperature is preferably 80° C., and the time is preferably 4 h. The $Al_2O_3$—$Gd_2O_3$—$ZrO_2$ spherical powder prepared by the present disclosure has better fluidity.

In the present disclosure, the $Al_2O_3$—$Gd_2O_3$—$ZrO_2$ spherical powder preferably has a particle size distribution of 10-50 μm, more preferably 15-45 μm, further preferably 15-30 μm; and the molar ratio of $Al_2O_3$, $Gd_2O_3$ and $ZrO_2$ in the $Al_2O_3$—$Gd_2O_3$—$ZrO_2$ spherical powder is preferably 58:19:23.

In the present disclosure, the laser cladding of the eutectic ceramic coating is preferably carbon dioxide laser cladding, and the equipment used is preferably a carbon dioxide laser. In the present disclosure, the spot diameter of the carbon dioxide laser is preferably 50 μm, and the maximum laser power is preferably 600 W. In the present disclosure, the laser power of the laser cladding of the eutectic ceramic coating is preferably 150-300 W, more preferably 200 W; the scanning rate is preferably 100-300 mm/s, more preferably 100-200 mm/s. In the present disclosure, the laser scanning direction for the laser cladding of the eutectic ceramic coating is preferably "zigzag" scanning within the layer, and alternate scanning in the XY direction rotated by 900 between the layers. The present disclosure utilizes carbon dioxide laser to clad the eutectic ceramic powder, which can improve the absorption rate of the eutectic ceramic powder to the laser, completely melt the powder, rapidly solidify the material to form the eutectic ceramic coating, improve the bonding strength of the coating and the substrate, and refine the microstructure to nanometer size.

In the present disclosure, the total number of layers stacked during the laser cladding of the eutectic ceramic coating is preferably 1-20 layers, more preferably 6-8 layers; the thickness of each layer is preferably 20-50 μm, more preferably 20-40 μm.

In the present disclosure, the laser cladding of the eutectic ceramic coating is preferably carried out in a protective atmosphere, particularly preferably in an argon atmosphere. The present disclosure limits the laser cladding of the substrate, the laser cladding of the intermediate binding layer, and the laser cladding of the eutectic ceramic coating under a protective atmosphere, which can effectively reduce the content of pores in the eutectic ceramic thermal barrier material.

The internal microstructure of the eutectic ceramic cladding layer prepared by the present disclosure is dense, which can improve the wear resistance, corrosion resistance, high temperature resistance and oxidation resistance of the eutectic ceramic thermal barrier material.

In the present disclosure, the specific method for laser cladding of the eutectic ceramic coating preferably includes:

Step one, setting processing parameters and scanning strategy;

Step two, placing the sample with the NiCoCrAlY binding layer cladded on the surface of the nickel-based superalloy substrate, and using a scraper to lay eutectic ceramic powder on the surface of the sample; the layer thickness of the eutectic ceramic powder is 0.01-0.1 mm, preferably 0.02-0.04 mm;

Step three, closing the door of the working cabin, opening the protective gas bottle, and turning on the purge button. When the oxygen content drops to less than 10 ppm, carrying out laser cladding to prepare the eutectic ceramic cladding layer.

The preparation method provided by the present disclosure has high efficiency, and has the characteristics of flexible manufacturing and free design and processing. In a specific embodiment, the present disclosure adopts the laser additive manufacturing technology, and uses a high-energy fiber laser to prepare the nickel-based superalloy substrate and the intermediate binding layer. The present disclosure adopts three-dimensional software for modeling and slicing processing, and sets laser processing strategies, which can improve processing accuracy, and has great advantages in the design and preparation of coatings on surfaces with complex shapes such as curved surfaces and cambers; the present disclosure uses a high-energy carbon dioxide laser to prepare the thermal barrier coating on the surface of the alloy. The eutectic ceramic powder can be completely melted by the high-energy laser beam, and rapidly solidified to form the set eutectic ceramic cladding layer. The obtained eutectic ceramic cladding layer has high bonding strength with the nickel-based superalloy substrate. The preparation method provided by the present disclosure has a fast forming speed. The forming speed of the eutectic ceramic cladding layer can reach a maximum of 5 m/s and a minimum of 0.147 m/s, which is higher than the processing speed of the traditional ceramic coating and greatly improves the preparation efficiency; The eutectic ceramic thermal barrier material prepared by the present disclosure has high forming accuracy; the thickness of the coating can be freely selected by adjusting the thickness of the layer and the number of processing layers; The eutectic ceramic thermal barrier material with good oxidation resistance, high temperature resistance and high bonding strength can be obtained by using the preparation method provided by the present disclosure.

The technical schemes of the present disclosure will be clearly and completely described below with reference to the embodiments of the present disclosure. Obviously, the described embodiments are only some, but not all, embodiments of the present disclosure. Based on the embodiments of the present disclosure, all other embodiments obtained by those of ordinary skill in the art without creative efforts shall fall within the protection scope of the present disclosure.

Example 1-4

The IN718 superalloy powder, NiCoCrAlY powder, and $Al_2O_3$—$Gd_2O_3$ powder were placed into an oven respectively, and dried at 80° C. for 4 h for use;

Magics software was used to build a cube model with a size of 8 mm×8 mm×5 mm and create model slicing information to generate a CLI. file;

ARPSM. software was opened to create a laser scanning strategy, generate a scanning strategy, and create an afi. file that can be recognized by a 3D printing equipment; the scanning line width was 0.075 mm, the scanning mode was "zigzag" scanning within the layer, and alternate scanning in the XY direction rotated by 900 between the layers;

Selective laser cladding was performed on the dried IN718 superalloy powder by a fiber laser, and the IN718 superalloy substrate was obtained by stacking layer by layer. The specific processing process was as follows:

Step one, the refrigeration dryer, air compressor, main power supply of the control cabinet, water cooler and power supply of the equipment were sequentially turned on, and the processing program on the computer control interface was opened, the lighting on the processing interface was clicked to illuminate the workbench; the motor button was turned on, the "door lock of the work cabin" was clicked to open the cabin, the "motor" button was clicked, and the workbench was adjusted to an appropriate processing position;

Step two, the afi. file was input into the computer control system and opened on the processing interface, the nickel-based superalloy powder was evenly deposited on the processing area of the substrate, and the layer thickness was 0.05 mm;

Step three, the processing parameters were set, the laser power and scanning rate were set in the control program, and the number of processing layers was 150;

Step four, the door of the working cabin was closed, the argon gas bottle was opened, and the purge button was turned on. When the oxygen content dropped to less than 200 ppm, the cooler, scanner, and laser were sequentially turned on; the ventilation and circulation system was set, the fan frequency was set to 20 Hz, the button was clicked to scan the current page; and the laser will perform a single-layer scan according to the set scanning strategy.

After scanning the first layer, the knob of the argon gas bottle was closed, the laser was turned off, the door lock of the working cabin was clicked to open the working cabin, and the IN718 superalloy powder was deposited with a thickness of 0.05 mm on the surface of the processing area using a scraper, step three and step four were repeated; Until the required IN718 superalloy substrate was processed, the laser was turned off, and the processing was completed; the laser was a fiber laser, the spot diameter was 75 μm, and the maximum laser power was 500 W;

The dried NiCoCrAlY powder was laser cladded on the surface of the IN718 superalloy substrate using a fiber laser to prepare an intermediate binding layer. The specific processing process was as follows:

Step one, the afi. file described was input into the computer control system and opened on the processing interface;

Step two, processing parameters were set; during the selective laser cladding, the laser power was 250 W, and the laser scanning rate was 0.833 m/s. In the present disclosure, the total number of layers stacked was 5 layers, the laser used in the laser cladding process was a fiber laser, the spot diameter was 75 μm, and the maximum laser power was 500 W;

Step three, the IN718 superalloy substrate was placed on the workbench, and a scraper was used to lay NiCoCrAlY alloy powder on the surface of the sample; the NiCoCrAlY powder was evenly deposited on the processing area of the substrate; and the thickness of the layer was 0.1 mm;

Step four, the door of the working cabin was closed, the argon gas bottle was opened, and the purge button was turned on. When the oxygen content dropped to less than 200 ppm, the cooler, scanner, and laser were sequentially turned on; the ventilation and circulation system was set, the fan frequency was set to 20 Hz, and selective laser cladding was carried out to prepare the NiCoCrAlY binding layer.

The dried $Al_2O_3$—$Gd_2O_3$ powder was laser cladded on the surface of the NiCoCrAlY binding layer using a carbon dioxide laser to prepare an $Al_2O_3/GdAlO_3$ binary eutectic ceramic coating. The specific processing process was as follows:

Step one, processing parameters and scanning strategy were set; the processing parameters are shown in Table 1. The scanning method is a "zigzag" scanning within the layers, and alternate scanning in the XY direction rotated by 900 between the layers. In the present disclosure, the total number of layers stacked was 15 layers, the laser used in the laser cladding process was a fiber laser, the spot diameter was 50 μm, and the maximum laser power was 250 W;

Step two, the sample with the binding layer cladded on the surface of the IN718 superalloy substrate was placed, and $Al_2O_3$—$Gd_2O_3$ powder was deposited on the surface of the sample using a scraper; and the thickness of the formed layer was 0.02 mm;

Step three, the door of the working cabin was closed, the protective gas bottle was opened, and the purge button was turned on. When the oxygen content dropped to less than 10 ppm, laser cladding was carried out to prepare the $Al_2O_3/GdAlO_3$ binary eutectic ceramic coating, and then the eutectic ceramic thermal barrier material was obtained.

The laser power, scanning rate and processing method are shown in Table 1.

Table 1 Processing parameters for preparing binary eutectic ceramic coatings in Examples 1-4

| | laser power | scanning rate |
|---|---|---|
| Example 1 | 275 W | 100 mm/s |
| Example 2 | 300 W | 100 mm/s |
| Example 3 | 325 W | 150 mm/s |
| Example 4 | 350 W | 200 mm/s |

Test Example 1

Morphologies of the $Al_2O_3/GdAlO_3$ binary eutectic ceramic coatings prepared in Examples 1-4 are shown in FIG. 1, wherein (a) in FIG. 1 shows the morphology of the $Al_2O_3/GdAlO_3$ binary eutectic ceramic coating prepared in Example 1, (b) in FIG. 1 shows the morphology of the $Al_2O_3/GdAlO_3$ binary eutectic ceramic coating prepared in Example 2, (c) in FIG. 1 shows the morphology of the $Al_2O_3/GdAlO_3$ binary eutectic ceramic coating prepared in Example 3, and (d) in FIG. 1 shows the morphology of the $Al_2O_3/GdAlO_3$ binary eutectic ceramic coating prepared in Example 4. It can be seen from FIG. 1 that the surface of the binary eutectic ceramic coating prepared by the present disclosure is uniform.

The coating strength was tested by the automatic scratch tester for coating adhesion with a model number of WS-2005 from Lanzhou Zhongke Kaihua Technology Development Co., Ltd. The surface of the test sample was required to be smooth and flat (roughness was less than 0.5 μm). The test process was as follows: under a loading of 70 N, the corresponding data curve was obtained by sliding the diamond indenter on the surface of the coating by a distance of 5 mm in length, and it was further obtained that the bonding strength of the binary eutectic ceramic coatings prepared in Examples 1-4 ranged from 10.5 N-16.3 N.

Test Example 2

The eutectic ceramic thermal barrier material prepared in Example 3 was ultrasonically cleaned, then weighed after drying at 50° C. for 2 h, subjected to heat treatment at 1000° C. for 100 h in a Carbolite sintering furnace, and weighed to calculate the mass of the eutectic ceramic thermal barrier material. The results show that there is no obvious ceramic spalling on the surface of the sample, and the maximum weight gain at 100 h is only 12% of that of the substrate. It shows that the eutectic ceramic thermal barrier material prepared by the present disclosure has good high temperature resistance and oxidation resistance.

Test Example 3

The hardness and fracture toughness of the eutectic ceramic thermal barrier materials prepared in Examples 1-4 were tested by an indentation method, and the specific methods were as follows: the surface of the sample was carefully ground and polished (roughness was up to 0.5 μm) to eliminate the influence of residual stress on the surface and improve the test accuracy; The hardness and fracture toughness data were obtained by using a microhardness tester with a model number of SHIMADAU-G20ST and a diamond indenter with a model number of S347-20344 Vickers Indentor 100D under a loading of 9.8 N for 15 s; Different areas were tested 10 times, and the indentation data obtained were substituted into the formula for calculation and the average value was taken. The hardness of the eutectic ceramic thermal barrier materials prepared in Examples 1-4 was 8.6-10.79 GPa, and the fracture toughness was 3.2-4.57 $MPa \cdot m^{1/2}$.

The hardness calculation formula is shown in formula I:

$$H_V = 1.8544\frac{P}{d^2}; \qquad \text{formula I}$$

In formula I, P is the indentation loading, taking 9.8 N; d is the average value of the indentation diagonal length, the unit is m; the unit of $H_v$ is GPa.

Fracture toughness calculation formula is shown in the formula II:

$$K_{IC} = 0.035 \times \left[\frac{H_V}{E}\right]^{-2/5}\left[\frac{l}{a}\right]^{-1/2} H_V a^{1/2}\phi^{-3/5}; \qquad \text{formula II}$$

In formula II, E(GPa) and $H_v$ (GPa) represent the elastic modulus and hardness of the material, respectively; 1 is the distance from the center of the indentation to the crack tip, the unit is m; a is the half-diagonal length of the indentation, the unit is m; factor φ=3.

Example 5-8

The IN718 superalloy powder, NiCoCrAlY powder, and $Al_2O_3$—$Gd_2O_3$—$ZrO_2$ powder were placed into an oven respectively, and dried at 80° C. for 4 h for use;

Magics software was used to build a cube model with a size of 15 mm×20 mm×5 mm and create model slicing information to generate a CLI. file;

ARPSM. software was opened to create a laser scanning strategy, generate a scanning strategy, and create an afi. file that can be recognized by a 3D printing equipment; the scanning line width was 0.075 mm, the scanning mode was "zigzag" scanning within the layer, and alternate scanning in the XY direction rotated by 90° between the layers;

Selective laser cladding was performed on the dried IN718 superalloy powder by a fiber laser, and the IN718 superalloy substrate was obtained by stacking layer by layer. The specific processing process was as follows:

Step one, the refrigeration dryer, air compressor, main power supply of the control cabinet, water cooler and power supply of the equipment were sequentially turned on, and the processing program on the computer control interface was opened, the lighting on the processing interface was clicked to illuminate the workbench; the motor button was turned on, the "door lock of the work cabin" was clicked to open the cabin, the "motor" button was clicked, and the workbench was adjusted to an appropriate processing position;

Step two, the afi. file was input into the computer control system and opened on the processing interface, the IN718 superalloy powder was evenly deposited on the processing area of the substrate, and the layer thickness was 0.05 mm;

Step three, processing parameters were set, the laser power and scanning rate were set in the control program, and the number of processing layers was 15;

Step four, the door of the working cabin was closed, the argon gas bottle was opened, and the purge button was turned on. When the oxygen content dropped to less than 200 ppm, the cooler, scanner, and laser were sequentially turned on; the ventilation and circulation system was set, the fan frequency was set to 20 Hz, the button was clicked to scan the current page; and the laser will perform a single-layer scan according to the set scanning strategy.

After scanning the first layer, the knob of the argon gas bottle was closed, the laser was turned off, the door lock of the working cabin was clicked to open the working cabin, and the IN718 superalloy powder was deposited with a thickness of 0.05 mm on the surface of the processing area using a scraper, step three and step four were repeated; Until the required IN718 superalloy substrate was processed, the laser was turned off, and the processing was completed; the laser was a fiber laser, the spot diameter was 75 μm, and the maximum laser power was 500 W;

The dried NiCoCrAlY powder was laser cladded on the surface of the IN718 superalloy substrate using a fiber laser to prepare an intermediate binding layer. The specific processing process was as follows:

Step one, the afi. file described was input into the computer control system and opened on the processing interface;

Step two, processing parameters were set; during the selective laser cladding, the laser power was 250 W, and the laser scanning rate was 0.833 m/s. In the present disclosure, the total number of layers stacked was 5 layers, the laser used in the laser cladding process was a fiber laser, the spot diameter was 75 μm, and the maximum laser power was 500 W;

Step three, the IN718 superalloy substrate was placed on the workbench, and a scraper was used to lay NiCoCrAlY alloy powder on the surface of the sample; the NiCoCrAlY powder was evenly deposited on the processing area of the substrate; and the thickness of the powder layer was 0.1 mm;

Step four, the door of the working cabin was closed, the argon gas bottle was opened, and the purge button was turned on. When the oxygen content dropped to less than 200 ppm, the cooler, scanner, and laser were sequentially turned on; the ventilation and circulation system was set, the fan frequency was set to 20 Hz, and selective laser cladding was carried out to prepare the NiCoCrAlY binding layer.

The dried $Al_2O_3$—$Gd_2O_3$—$ZrO_2$ powder was laser cladded on the surface of the NiCoCrAlY binding layer using a carbon dioxide laser to prepare an $Al_2O_3/GdAlO_3/ZrO_2$ ternary eutectic ceramic coating. The specific processing process was as follows:

Step one, processing parameters and scanning strategy were set; the processing parameters are shown in Table 2. The scanning method was a "zigzag" scanning within the layers, and alternate scanning in the XY direction rotated by 900 between the layers. In the present disclosure, the total number of layers stacked was 15 layers, the laser used in the laser cladding process was a fiber laser, the spot diameter was 50 μm, and the maximum laser power was 250 W;

Step two, the sample with the binding layer cladded on the surface of the IN718 superalloy substrate was placed, and $Al_2O_3$—$Gd_2O_3$—$ZrO_2$ powder was deposited on the surface of the sample using a scraper; and the thickness of the formed layer was 0.04 mm;

Step three, the door of the working cabin was closed, the protective gas bottle was opened, and the purge button was turned on. When the oxygen content dropped to less than 10 ppm, laser cladding was carried out to prepare the $Al_2O_3/GdAlO_3/ZrO_2$ ternary eutectic ceramic coating, and then the eutectic ceramic thermal barrier material was obtained.

The laser power, scanning rate and processing method are shown in Table 2.

Table 2 Processing parameters for preparing ternary eutectic ceramic coatings in Examples 5-8

| | laser power | scanning rate |
|---|---|---|
| Example 5 | 250 W | 100 mm/s |
| Example 6 | 250 W | 200 mm/s |
| Example 7 | 150 W | 300 mm/s |
| Example 8 | 200 W | 250 mm/s |

Test Example 4

Figure 2:
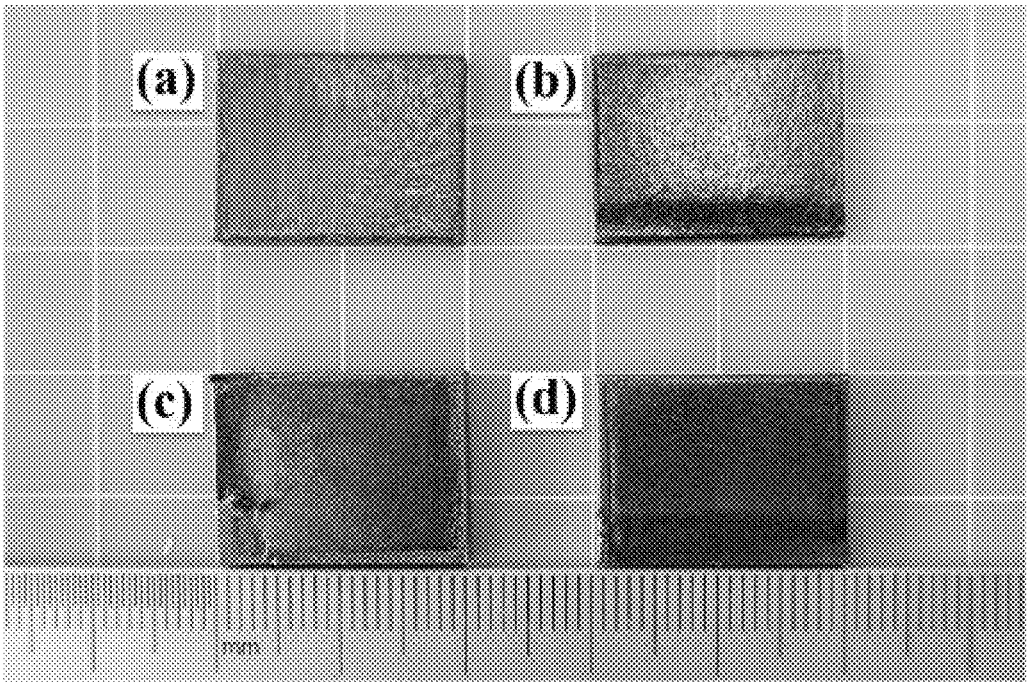
FIG. 2 shows morphology of $Al_2O_3/GdAlO_3/ZrO_2$ ternary eutectic ceramic coatings prepared in Examples 5-8.

Morphologies of the $Al_2O_3/GdAlO_3/ZrO_2$ ternary eutectic ceramic coatings prepared in Examples 5-8 are shown in FIG. 2, wherein (a) in FIG. 2 shows the morphology of the $Al_2O_3/GdAlO_3/ZrO_2$ ternary eutectic ceramic coating prepared in Example 5, (b) in FIG. 2 shows the morphology of the $Al_2O_3/GdAlO_3/ZrO_2$ ternary eutectic ceramic coating prepared in Example 6, (c) in FIG. 2 shows the morphology of the $Al_2O_3/GdAlO_3/ZrO_2$ ternary eutectic ceramic coating prepared in Example 7, and (d) in FIG. 2 shows the morphology of the $Al_2O_3/GdAlO_3/ZrO_2$ ternary eutectic ceramic coating prepared in Example 8. It can be seen from FIG. 2 that the surface of the ternary eutectic ceramic coating prepared by the present disclosure is uniform.

The coating strength was tested by the automatic scratch tester for coating adhesion with a model number of WS-2005 from Lanzhou Zhongke Kaihua Technology Development Co., Ltd. The surface of the test sample was required to be smooth and flat (roughness was less than 0.5 μm). The test process was as follows: under a loading of 70 N, the corresponding data curve was obtained by sliding the diamond indenter on the surface of the coating by a distance of 5 mm in length, and it was further obtained that the bonding strength of the ternary eutectic ceramic coatings prepared in Examples 5-8 ranged from 10 N-15.9 N.

Test Example 5

The eutectic ceramic thermal barrier material prepared in Example 7 was ultrasonically cleaned, then weighed after drying at 50° C. for 2 h, subjected to heat treatment at 1000° C. for 100 h in a Carbolite sintering furnace, and weighed to calculate the mass of the eutectic ceramic thermal barrier material. The results show that there is no obvious ceramic spalling on the surface of the sample, and the maximum weight gain at 100 h is only 10% of that of the substrate. It shows that the eutectic ceramic thermal barrier material prepared by the present disclosure has good high temperature resistance and oxidation resistance.

Test Example 6

The hardness and fracture toughness of the eutectic ceramic thermal barrier materials prepared in Examples 5-8 were tested by an indentation method, and the specific methods were as follows: the surface of the sample was carefully ground and polished (roughness was up to 0.5 μm) to eliminate the influence of residual stress on the surface and improve the test accuracy; The hardness and fracture toughness data were obtained by using a microhardness tester with a model number of SHIMADAU-G20ST and a diamond indenter with a model number of S347-20344 Vickers Indentor 100D under a loading of 9.8 N for 15 s; Different areas were tested 10 times, and the indentation data obtained were substituted into the formula I and formula II for calculation and the average value was taken. The hardness of the eutectic ceramic thermal barrier materials prepared in Examples 5-8 was 10.2-14.79 GPa, and the fracture toughness was 3.2-3.8 $MPa \cdot m^{1/2}$.

The above are only the preferred embodiments of the present disclosure. It should be pointed out that for those skilled in the art, without departing from the principles of the present disclosure, several improvements and modifications can be made, and these improvements and modifications should also be regarded as the protection scope of the present disclosure.

What is claimed is:

1. A method for preparing a eutectic ceramic thermal barrier material, comprising the steps of:

(1) Subjecting a nickel-based superalloy powder to laser cladding, and stacking layer by layer to obtain a nickel-based superalloy substrate;

(2) Subjecting a NiCoCrAlY powder to laser cladding on a surface of the nickel-based superalloy substrate, and stacking layer by layer to obtain an intermediate binding layer; and (3) Subjecting a eutectic ceramic powder to laser cladding on a surface of the intermediate binding layer, stacking layer by layer to obtain a eutectic ceramic cladding layer, and then to obtain the eutectic ceramic thermal barrier material; and the eutectic ceramic powder comprises an $Al_2O_3$—$Gd_2O_3$ spherical powder or an $Al_2O_3$—$Gd_2O_3$—$ZrO_2$ spherical powder;

wherein the eutectic ceramic thermal barrier material comprises the nickel-based superalloy substrate, the intermediate binding layer and the eutectic ceramic cladding layer stacked sequentially; the intermediate binding layer comprises a NiCoCrAlY binding layer; the eutectic ceramic cladding layer comprises an $Al_2O_3/GdAlO_3$ binary eutectic ceramic coating or an $Al_2O_3/GdAlO_3/ZrO_2$ ternary eutectic ceramic coating.

2. The method according to claim 1, wherein the nickel-based superalloy substrate comprises an IN718 superalloy substrate; and wherein the nickel-based superalloy substrate has a thickness of 2-100 mm.

3. The method according to claim 1, wherein the intermediate binding layer has a thickness of 50-200 μm.

4. The method according to claim 1, wherein the eutectic ceramic cladding layer has a thickness of 300-750 μm.

5. The method according to claim 1, wherein the laser cladding in step (1) is fiber laser cladding.

6. The method according to claim 1, wherein the laser cladding in step (2) is fiber laser cladding.

7. The method according to claim 1, wherein the laser cladding in step (3) is carbon dioxide laser cladding.

8. The method according to claim 7, wherein the $Al_2O_3$—$Gd_2O_3$ spherical powder in step (3) has a particle size distribution of 10-50 μm; and wherein a molar ratio of $Al_2O_3$ and $Gd_2O_3$ in the $Al_2O_3$—$Gd_2O_3$ spherical powder is 77:23.

9. The method according to claim 7, wherein the $Al_2O_3$—$Gd_2O_3$—$ZrO_2$ spherical powder in step (3) has a particle size distribution of 10-50 μm; and wherein a molar ratio of $Al_2O_3$, $Gd_2O_3$ and $ZrO_2$ in the $Al_2O_3$—$Gd_2O_3$—$ZrO_2$ spherical powder is 58:19:23.

10. The method according to claim 1, wherein the $Al_2O_3$—$Gd_2O_3$ spherical powder in step (3) has a particle size distribution of 10-50 μm; and wherein a molar ratio of $Al_2O_3$ and $Gd_2O_3$ in the $Al_2O_3$—$Gd_2O_3$ spherical powder is 77:23.

11. The method according to claim 1, wherein the $Al_2O_3$—$Gd_2O_3$—$ZrO_2$ spherical powder in step (3) has a particle size distribution of 10-50 μm; and wherein a molar ratio of $Al_2O_3$, $Gd_2O_3$ and $ZrO_2$ in the $Al_2O_3$—$Gd_2O_3$—$ZrO_2$ spherical powder is 58:19:23.

* * * * *